United States Patent [19]

Michael

[11] 4,033,143

[45] July 5, 1977

[54] CLIP RING

[76] Inventor: Doreen Elizabeth Michael, 4115 208th St., Langley, British Columbia, Canada, V3A 2H3

[22] Filed: Feb. 11, 1976

[21] Appl. No.: 657,214

[52] U.S. Cl. ..... 63/2; 63/23; 24/237; 24/3 J; 24/259 C; 224/28 F

[51] Int. Cl.[2] ..... A44C 25/00; A44B 13/02

[58] Field of Search ..... 24/261 C, 259 C, 259 R, 24/259 FC, 3 J, 3 R, 73 FA, 73 J, 84 B, 237; 63/15.45, 15.5, 30, 11, 23; 224/28 F

[56] References Cited

UNITED STATES PATENTS

| | | | |
|---|---|---|---|
| 471,332 | 3/1892 | Bailly | 24/261 C |
| 701,068 | 5/1902 | Mays | 24/261 C |
| 891,161 | 6/1908 | Goodwin | 63/30 |
| 1,083,853 | 1/1914 | Overbeck | 24/261 C |

FOREIGN PATENTS OR APPLICATIONS

| | | | |
|---|---|---|---|
| 431,654 | 11/1911 | France | 24/261 C |
| 737,464 | 12/1932 | France | 63/29 R |
| 2,120,856 | 11/1971 | Germany | 63/29 R |

*Primary Examiner*—Bernard A. Gelak

[57] ABSTRACT

In a ring, bracelet, or similar piece of metal jewelry which holds a charm link or other object onto itself in a manner in which the object is removeable manually, the mechanisms used are known to be spring rings or clips, which operate independently of the ring itself and are opened and/or closed by the pushing, pulling, squeezing or lifting of the clip or a part of the clip itself. In this invention, the clip is opened by the squeezing of the ring itself.

5 Claims, 4 Drawing Figures

CLIP RING

FIELD OF THE INVENTION

This invention relates to a metal ring or similar piece of jewelry which is in itself a manually operable clipping device for holding objects.

DESCRIPTION OF PRIOR ART

It is common in devices for holding objects onto metal rings or similar pieces of jewelry to consist of a hinged or spring closing mechanism, or else consist of wire fixed to the ring, bent and tempered in such a way as to retain a tension which would allow an object pushed or pulled into its opening to be held by the spring action of the wire. Clips of the springed or hinged types have the disadvantage of the extra work involved in their manufacture by their being made of two or more pieces which must be formed and fitted together separately from the rest of the ring and then soldered onto it, and both these types of clips and the tempered wire clips have the disadvantage that, in order to avoid being cumbersome to the wearer, the clipping mechanism must have a relatively small size in proportion to the size of the ring, which may make operation by the fingers difficult.

SUMMARY OF INVENTION

I have found that these disadvantages may be overcome by the one piece construction of a clip ring in which the ring itself is the operating mechanism of the clip, thereby providing a simpler method of construction and providing a larger mechanism for easier operation of the clip by the fingers.

BRIEF DESCRIPTION OF DRAWINGS

In drawings which illustrate this invention,

FIGS. 2 and 4 illustrate two possible cuts or castings of metal used to form the clip ring.

DESCRIPTION OF PREFERRED EMBODIMENTS

Figure 2:
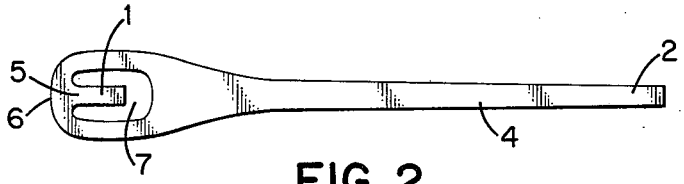
FIG. 2 is a top plan view of this embodiment prior to shaping.
Figure 4:
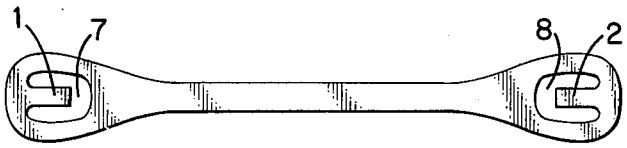
FIG. 4 is a top plan view of this embodiment prior to shaping.

The length of the piece illustrated in FIG. 2 must be equal to the circumference of the ring size desired, minus an allowance for expansion due to hammering, plus the desired length of prong 2, plus the desired distance between the base of prong 1 (point 5) and the unpronged end of the ring (point 6). In FIG. 4 the distance between the base of prong 1 and prong 2 must be equal to the circumference of the ring size desired, minus an allowance for expansion due to hammering.

The thickness of metal used to form the ring must be in a proportion to the circumference of the ring which when tempered will provide the required amount of springyness necessary to open the clip when the ring is squeezed and close it when released.

Figure 1:
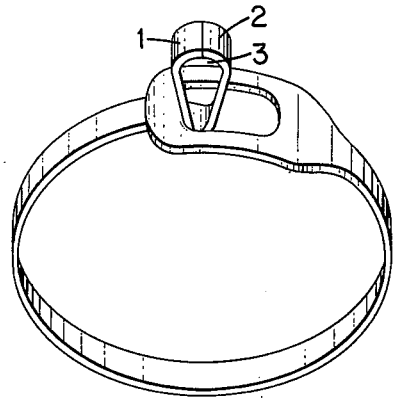
FIG. 1 is a side plan view of one embodiment.
Figure 3:
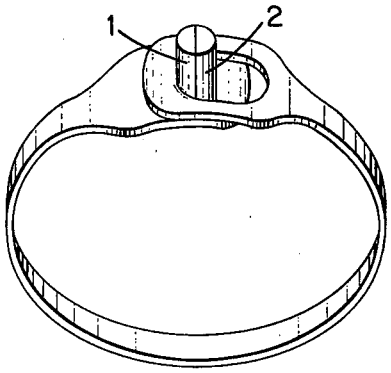
FIG. 3 is a side plan view of another embodiment having parallel prongs and two slots.

To form the clip from the piece illustrated in FIG. 2 it is necessary to bend prong 1 upward and to bend the piece around to a position where prong 2 can be put through slot 7. The ring may then be rounded and prongs 1 and 2 may either be formed parallel to each other as in FIG. 3 or shaped with an opening such as opening 3 in FIG. 1.

The ring may then be tempered by hammering to produce the springyness desired.

In FIG. 4 either slot 7 or slot 8 may be used for the clipping slot.

The prongs in FIGS. 2 and 4 may be originally cast perpendicular to the rest of the piece.

Rings formed from the piece pictured in FIG. 2 may be made smaller by cutting off the necessary length of section 4 before shaping prong 2.

What I claim is:

1. Piece of jewelry formed from a resilient, single piece of material and having overlapping inner and outer ends; an opening adjacent but spaced from the extremities of the outer end; a prong attached to that part of the rim of the opening adjacent the extremity of the outer end; a radially oriented part of the inner end extending through said opening to abut said prong to maintain a predetermined shape for the ring.

2. A piece of jewelry as set forth in claim 1, wherein the radially oriented portion of the inner end is substantially parallel to the prong on the outer end.

3. A piece of jewelry as set forth in claim 1, wherein the tip of the radially oriented portion of the inner end abuts the tip of the prong on the outer end.

4. A strip of metal used to form the piece of jewelry set forth in claim 1, having one narrowed end and one wider end containing an opening adjacent but spaced from the extremity of the wider end and a prong projecting from that part of the rim of said opening nearer the adjacent end.

5. A strip of metal used to form the piece of jewelry set forth in claim 1, having an opening adjacent but spaced from the extremity of each end and prongs projecting from said opening on that part of the rim of each opening nearer the adjacent end.

* * * * *